US007992986B2

(12) United States Patent
Snyder et al.

(10) Patent No.: US 7,992,986 B2
(45) Date of Patent: Aug. 9, 2011

(54) METHOD FOR INCREASING PRINTHEAD RELIABILITY

(75) Inventors: Trevor James Snyder, Newberg, OR (US); Terry Wayne Olson, Milwaukie, OR (US)

(73) Assignee: Xerox Corporation, Norwalk, CT (US)

( * ) Notice: Subject to any disclaimer, the term of this patent is extended or adjusted under 35 U.S.C. 154(b) by 758 days.

(21) Appl. No.: 12/049,883

(22) Filed: Mar. 17, 2008

(65) Prior Publication Data

US 2009/0231378 A1 Sep. 17, 2009

(51) Int. Cl.
*B41J 29/38* (2006.01)
*B41J 2/175* (2006.01)
*B41J 11/00* (2006.01)

(52) U.S. Cl. ..... 347/88; 347/17; 347/99

(58) Field of Classification Search ..... 347/17, 347/88, 99

See application file for complete search history.

(56) References Cited

U.S. PATENT DOCUMENTS

| | | | | |
|---|---|---|---|---|
| 6,350,012 | B1 | 2/2002 | Sarkissian et al. | |
| 6,595,620 | B2 * | 7/2003 | Kubota et al. | 347/35 |
| 7,111,917 | B2 | 9/2006 | Hill et al. | |
| 7,121,658 | B2 | 10/2006 | Platt et al. | |
| 7,144,100 | B2 | 12/2006 | Hill et al. | |
| 7,188,941 | B2 | 3/2007 | Platt et al. | |
| 7,841,692 | B2 * | 11/2010 | Taga | 347/30 |
| 2006/0209146 | A1 | 9/2006 | Reeves | |

* cited by examiner

*Primary Examiner* — Julian D Huffman
*Assistant Examiner* — Jason S Uhlenhake
(74) *Attorney, Agent, or Firm* — Maginot, Moore & Beck LLP

(57) ABSTRACT

A method of reducing intermittent weak or missing (IWM) jet failures in a phase change ink imaging device comprises fluidly connecting a positive pressure source to a print head assembly of a phase change ink imaging device. The print head assembly includes a plurality of ink jets for emitting ink drops onto an ink receiver. The method includes activating the pressure source to deliver a positive pressure pulse to the print head assembly. The pressure pulse is delivered at substantially a purge pressure. The pressure pulse has a pulse duration such that the pressure pulse bulges ink from the plurality of ink jets without emitting ink from the plurality of ink jets.

20 Claims, 5 Drawing Sheets

| TEST # | IWM'S AT | IWM'S AT | | | | | |
|---|---|---|---|---|---|---|---|
| | t=5 min. | t=15 | t=30 | t=45 | t=60 | t=75 | t=90 |
| 1 (BASELINE) | 24 | 26 | 14 | 14 | 11 | 11 | 9 |
| 2 | 36 | 4 | 4 | 4 | 3 | 3 | 3 |
| 3 | 18 | 2 | 2 | 2 | 2 | 2 | 2 |

FIG. 6

METHOD FOR INCREASING PRINTHEAD RELIABILITY

TECHNICAL FIELD

This disclosure relates generally to phase change ink jet printers, and in particular, to a method of preventing nozzle contamination in order to maintain the stable operation of the print head assembly used in phase change ink jet printers.

BACKGROUND

Solid ink or phase change ink printers conventionally receive ink in a solid form, sometimes referred to as solid ink sticks. The solid ink sticks are typically inserted through an insertion opening of an ink loader for the printer, and are moved by a feed mechanism and/or gravity toward a heater plate. The heater plate melts the solid ink impinging on the plate into a liquid that is delivered to a printhead assembly for jetting onto a recording medium. The recording medium is typically paper or a liquid layer supported by an intermediate imaging member, such as a metal drum or belt, A printhead assembly of a phase change ink printer typically includes one or more printheads each having a plurality of ink jets from which drops of melted solid ink are ejected towards the recording medium. The ink jets of a printhead receive the melted ink from an ink supply chamber, or manifold, in the printhead which, in turn, receives ink from a source, such as a melted ink reservoir or an ink cartridge. Each ink jet includes a channel having one end connected to the ink supply manifold. The other end of the ink channel has an orifice, or nozzle, for ejecting drops of ink. The nozzles of the ink jets may be formed in an aperture, or nozzle plate that has openings corresponding to the nozzles of the ink jets. During operation, drop ejecting signals activate actuators in the ink jets to expel drops of fluid from the ink jet nozzles onto the recording medium. By selectively activating the actuators of the ink jets to eject drops as the recording medium and/or printhead assembly are moved relative to each other, the deposited drops can be precisely patterned to form particular text and graphic images on the recording medium.

One difficulty faced by fluid ink jet systems is partially or completely blocked ink jets. Partially or completely blocked ink jets may be caused by any of a number of factors including contamination from dust or paper fibers, dried ink, etc. In addition, when the solid ink printer is turned off, the ink that remains in the print head can freeze. When the printer is turned back on and warms up, the ink thaws in the print head. Air that was once in solution in the ink can come out of solution to form air bubbles or air pockets that can become lodged in the ink pathways of the print head. Partially or completely blocked ink jets can lead to ink jet malfunctions or failures resulting in missing, undersized or misdirected drops on the recording media that degrade the print quality. When a jet failure cannot be recovered by a print head maintenance action, the result is a permanent or chronic weak or missing (CWM) jet failure. CWM jet failures may require the replacement of an entire print head or section of the print head that includes the CWM failure(s).

Temporary jet failures, also called intermittent weak or missing (IWM) jet failures are caused by a number of different factors including but not limited to those described above for a CWM. These IWM's may be recovered by performing a printhead maintenance action. Print head maintenance generally includes purging ink through the ink pathways and nozzles of a print head assembly in order to clear contaminants, air bubbles, dried ink, etc. from the print head assembly and/or wiping the nozzle plate of the print head assembly. Printing must typically be stopped and a relatively significant amount of time may be expended while a purging and/or wiping procedure is performed.

Tests have shown, however, that IWM jet failures may recover automatically after a sufficient amount of time has passed (about 30 sec to 2 minutes, for example) without the need of performing a maintenance procedure. Therefore, IWM jet failures may recover without having to stop printing to perform the procedure. Print quality, however, may continue to be impacted while awaiting the automatic recovery of IWM jet failures.

SUMMARY

A method of reducing or eliminating intermittent weak or missing (IWM) jet failures in a phase change ink imaging device has been developed that is configured to quickly recover IWM jet failures without having to perform a purge procedure and without waiting for the IWM jet failures to recover inherently, The method comprises connecting a positive pressure source to a print head assembly of a phase change ink imaging device. The print head assembly includes a plurality of ink jets for emitting ink drops onto an ink receiver. The method includes activating the positive pressure source to deliver a positive pressure pulse to the print head assembly. The positive pressure pulse is delivered at substantially a purge pressure. The positive pressure pulse has a pulse duration such that the positive pressure pulse bulges ink from the plurality of ink jets without emitting ink from the plurality of ink jets.

In another embodiment, a system for reducing intermittent weak or missing (IWM) jet failures in an ink jet imaging device is provided. The system comprises a positive pressure source fluidly connected to a print head assembly of an ink jet imaging device to deliver a purge pressure to the print head assembly The system includes a maintenance controller for activating the positive pressure source to deliver a positive pressure pulse to the print head assembly. The positive pressure pulse is delivered at substantially the purge pressure, and has a pulse duration such that the positive pressure pulse bulges ink from the plurality of ink jets without emitting ink from the plurality of ink jets.

In yet another embodiment, a phase change ink imaging device is provided. The phase change ink imaging device includes a print head assembly for ejecting ink onto an ink receiver, and an air pump configured to deliver a positive pressure. A passage fluidly connects the air pump to the print head assembly. The imaging device includes a maintenance controller for activating the air pump to deliver a positive pressure pulse to the print head assembly via the passage. The positive pressure pulse is delivered at a pressure between approximately 0.1 and approximately 8 psi., and the positive pressure pulse has a pulse duration being between approximately 0.05 seconds and approximately 1.5 seconds.

BRIEF DESCRIPTION OF THE DRAWINGS

The foregoing aspects and other features of a fluid transport apparatus and an ink imaging device incorporating a fluid transport apparatus are explained in the following description, taken in connection with the accompanying drawings, wherein:

FIG. 6 is a chart showing data generated during three tests showing the effect of delivering a high pressure short duration pressure pulse to the print head assembly using the purge system of FIG. 4.

DETAILED DESCRIPTION

Figure 1:
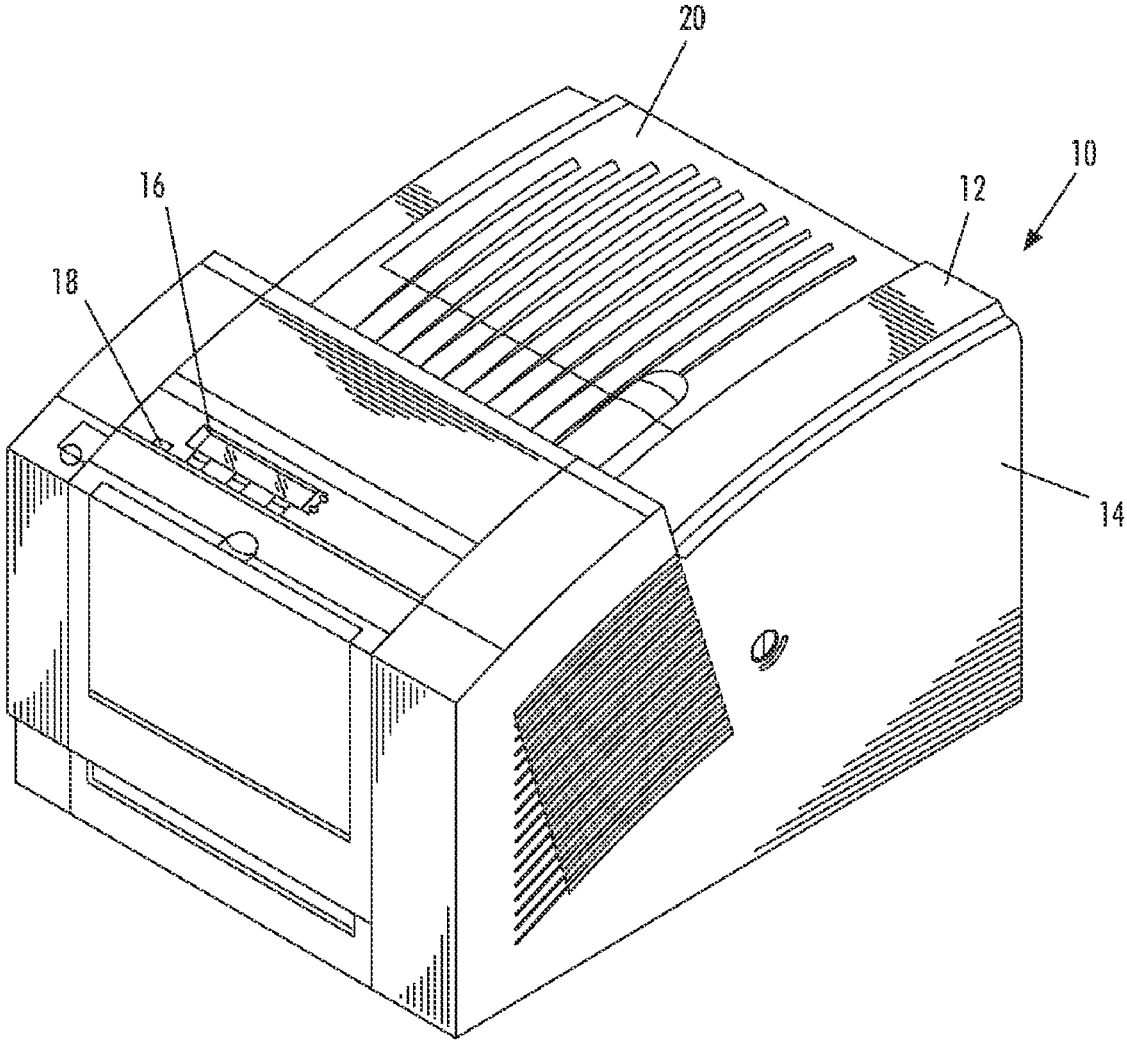
FIG. 1 is a perspective view of a prior art phase change imaging device having a fluid transport apparatus described herein.

For a general understanding of the present embodiments, reference is made to the drawings. In the drawings, like reference numerals have been used throughout to designate like elements.

Referring to FIG. 1, there is shown a perspective view of an ink printer 10 that implements a solid ink offset print process. The reader should understand that the embodiment discussed herein may be implemented in many alternate forms and variations and is not limited to solid ink printers only. The system and process described below may be used in image generating devices that operate components at different temperatures and positions to conserve the consumption of energy by the image generating device. Additionally, the principles embodied in the exemplary system and method described herein may be used in devices that generate images directly onto media sheets. In addition, any suitable size, shape or type of elements or materials may be used.

The ink printer 10 includes an outer housing having a top surface 12 and side surfaces 14. A user interface display, such as a front panel display screen 16, displays information concerning the status of the printer, and user instructions. Buttons 18 or other control mechanisms for controlling operation of the printer are adjacent the user interface window, or may be at other locations on the printer. An ink jet printing mechanism is contained inside the housing. The top surface of the housing includes a hinged ink access cover 20 that opens as shown in FIG. 2, to provide the user access to the ink feed system.

Figure 2:
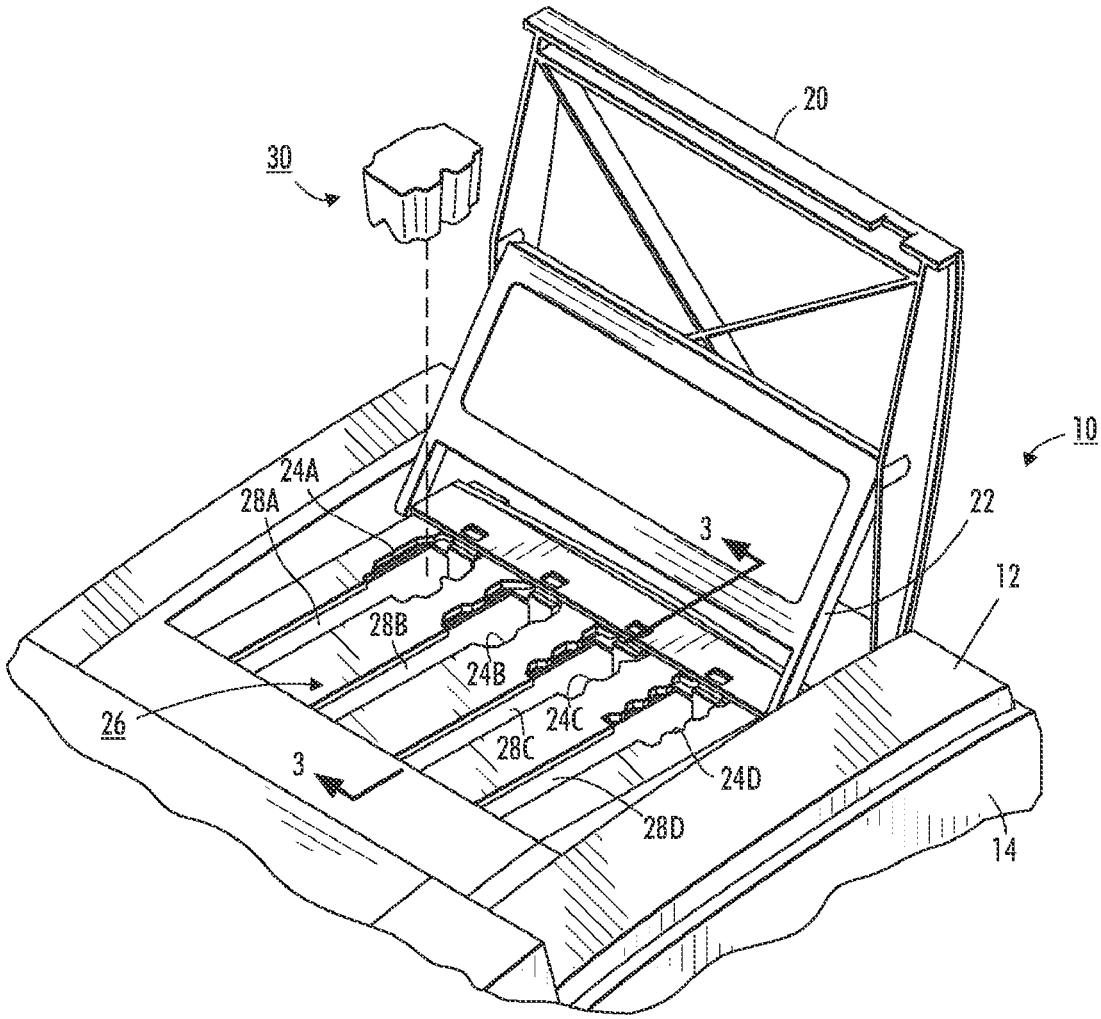
FIG. 2 is an enlarged partial top perspective view of the phase change imaging device of FIG. 1 with the ink access cover open, showing a solid ink stick in position to be loaded into a feed channel.

In the particular printer shown in FIG. 2, the ink access cover 20 is attached to an ink load linkage element 22 so that when the printer ink access cover 20 is raised, the ink load linkage 22 slides and pivots to an ink load position. As seen in FIG. 2, opening the ink access cover reveals a key plate 26 having keyed openings 24A-D. Each keyed opening 24A, 24B, 24C, 24D provides access to an insertion end of one of several individual feed channels 28A, 28B, 28C, 28D of the solid ink feed system.

A color printer typically uses four colors of ink (yellow, cyan, magenta, and black). Ink sticks 30 of each color are delivered through one of the feed channels 28A-D having the appropriately keyed opening 24A-D that corresponds to the shape of the colored ink stick. The key plate 26 has keyed openings 24A, 24B, 24C, 24D to aid the printer user in ensuring that only ink sticks of the proper color are inserted into each feed channel. Each keyed opening 24A, 24B, 24C, 24D of the key plate has a unique shape. The ink sticks 30 of the color for that feed channel have a shape corresponding to the shape of the keyed opening. The keyed openings and corresponding ink stick shapes exclude from each ink feed channel ink sticks of all colors except the ink sticks of the proper color for that feed channel.

Figure 3:
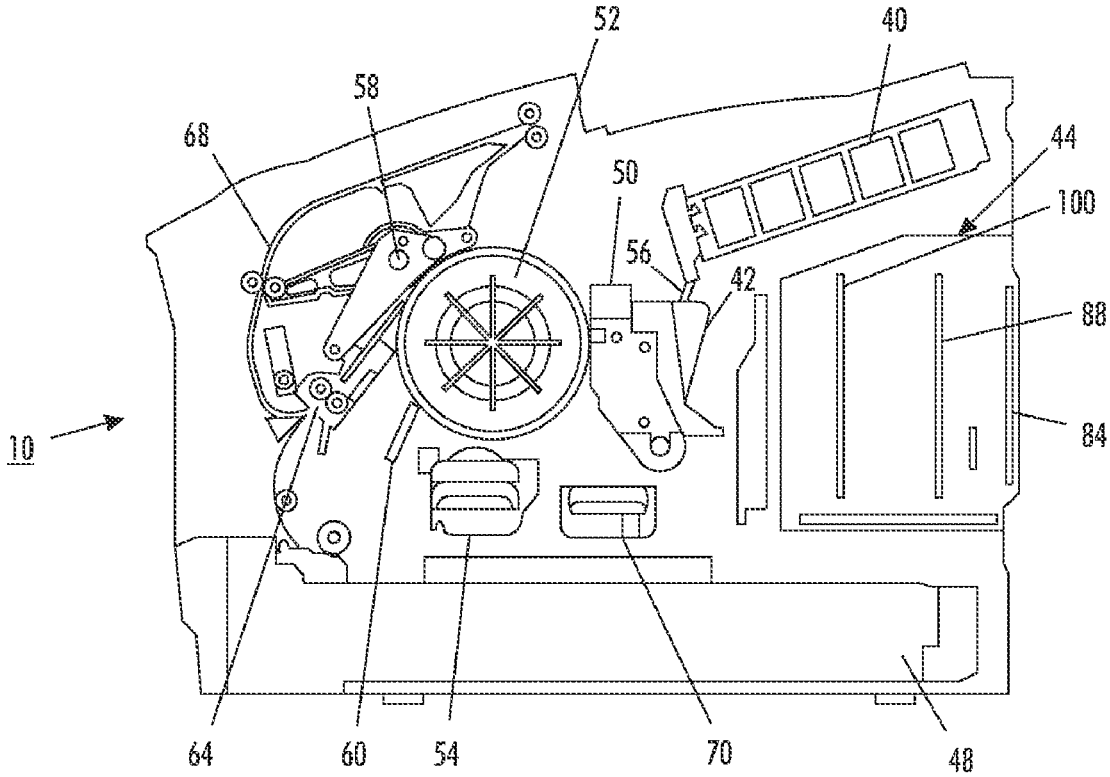
FIG. 3 is a side view of the imaging device shown in FIG. 1 depicting the major subsystems of the ink imaging device.

Referring now to FIG. 3, the ink printer 10 may include an ink loading subsystem 40, an electronics module 44, a paper/media tray 48, a print head assembly 50, an intermediate imaging member 52, a drum maintenance subsystem 54, a transfer subsystem 58, a drum maintenance wiper subassembly 60, a paper/media preheater 64, a duplex print path 68, and an ink waste tray 70. Solid ink sticks 30 are loaded into ink loader feed path 40 through which they travel to a solid ink stick melting assembly (not shown in the figure). The solid ink sticks may be transported by gravity and/or urged by a drive member, such as, for example, a belt or spring, toward a melt plate in the melting assembly. At the melting assembly 32, the ink stick is melted and the liquid ink is delivered to one or more ink reservoirs 42 through a transport conduit 56 or through the air as driven by gravity.

The print head assembly 50 receives liquid ink from the reservoir as needed for jetting onto a recording medium. The ink is ejected from the print head assembly 50 by piezoelectric elements through apertures (not shown) to form an image on the intermediate imaging member 52 as the member rotates. An intermediate imaging member heater is controlled by a controller 100 in the electronics module 44 to maintain the imaging member within an optimal temperature range for generating an ink image and transferring it to a sheet of recording media. A sheet of recording media is removed from the paper/media tray 48 and directed into the paper pre-heater 64 so the sheet of recording media is heated to a more optimal temperature for receiving the ink image. Recording media movement between the transfer roller in the transfer subsystem 58 and the intermediate image member 52 is coordinated for the fusing and transfer of the image. Please refer to U.S. Pat. No. 7,188,941, entitled "Valve for Printing Apparatus," U.S. Pat. No. 7,144,100 entitled "Purgeable Print Head Reservoir," and U.S. Pat. No. 7,121,658 entitled "Purgeable Print Head Reservoir," for description of exemplary embodiments of the print head assembly 50 and which are each hereby incorporated herein by reference in its entirety.

The print head assembly 50 may include a print head for each composite color. For example, a color printer may have one print head for emitting black ink, another print head for emitting yellow ink, another print head for emitting cyan ink, and another print head for emitting magenta ink. In this embodiment, ink sticks 30 of each color are delivered through separate feed channels to a melt plate. Consequently, each channel may have a melt plate, ink reservoir, and print head that is independent from the corresponding components for the other colors. Thus, each print head of the print head assembly may include a reservoir for holding ink for that print head. Other print head assembly configurations, however, are contemplated. For instance, the print head assembly may comprise one printhead that receives ink from a plurality of on-board ink reservoirs. In another embodiment, a single reservoir may supply ink to a plurality of print heads.

The various machine functions are regulated by a system controller 100 implemented in the electronics module 44. The controller 100 is preferably a programmable controller, such as a microprocessor, which controls the machine functions described. The controller also generates control signals that are delivered to the components and subsystems through the interface components. These control signals, for example, drive the piezoelectric elements to expel ink from the ink jet arrays in the print head assembly 50 to form an image on the imaging member 52 as the member rotates past the print head.

As mentioned above, one difficulty faced by fluid ink jet systems is intermittent weak or missing (IWM) jet failures. In order to recover and/or prevent IWM jet failures, the printing apparatus 10 may include a maintenance system for periodically performing a maintenance procedure on the printhead assembly. As explained below, the maintenance system is configured to introduce a positive pressure into the one or more reservoirs 42 of the print head assembly. The positive pressure introduced into the reservoirs pressurizes the ink in the channels and cavities of the print head assembly causing the ink to move toward the orifices of the ink jets. Ink may be purged through the orifices of the print head assembly by introducing a positive purge pressure into the reservoirs of the print head assembly for a predetermined duration. Purge pressures are typically a few to several psi, and, in one embodiment, is approximately 4.1 psi. After purging, the maintenance system may include a wiping blade for wiping the orifice place of the print head assembly. To prevent ink from being pushed back into the print head through the orifice during wiping, the maintenance system may also be configured to deliver a low pressure assist pressure to the print head assembly, which in an exemplary embodiment is about 0.04 psi. Thus, the maintenance system is configured to deliver air under pressure to the print head assembly at both the purge pressure and the assist pressure.

Figure 4:
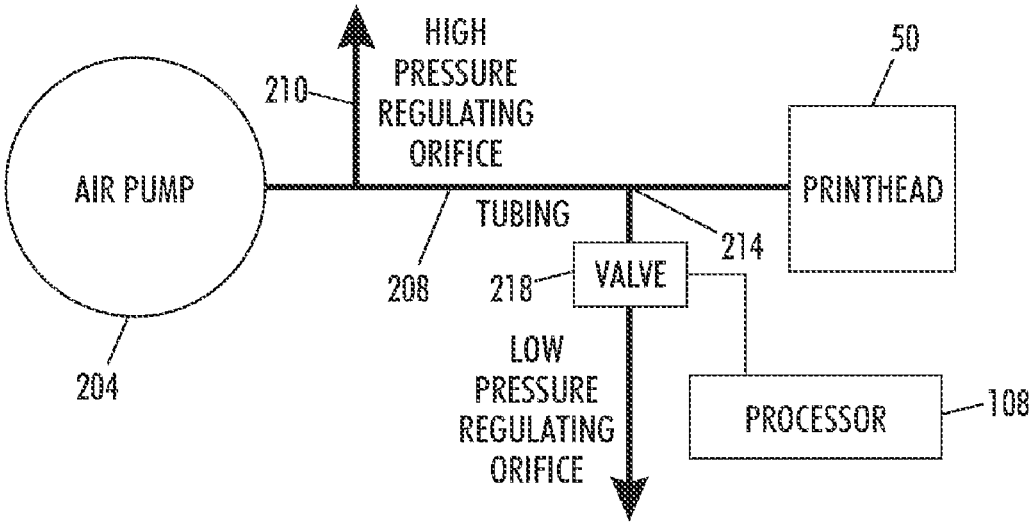
FIG. 4 is a schematic of a positive pressure purge system that can deliver at least two distinct pressures to the print head assembly of the imaging device.

Referring now to FIG. 4, there is shown an embodiment of a purge system for the phase change ink jet printer 10 that is capable of delivering positive pressure to the print head assembly 50 at both the purge pressure and the assist pressure. The purge system includes an air pump 204. The pump 204 in the exemplary embodiment is a rotary diaphragm air pump; however, any suitable type of air pump may be used. The pump 204 is in communication with the print head assembly 50, and in particular, the reservoirs 42 (not shown in FIG.4) of the print head assembly 50 via a passage 208. The passage 208 may be formed of any suitable material such as plastic tubing. The pump 204 runs at a predetermined rate that delivers a known pressure through the passage 208 because the diameter, length and other characteristics of the passage 208 are known. In the embodiment of FIG. 4, the pump 204 is configured to run at a rate that delivers a pressure through the passage 208 that is higher than the desired purge pressure of the print head.

The passage 208 includes two openings to control the pressure being delivered to the print head 50. A first opening 210 is provided to bleed off a portion of the fluid, which in the exemplary embodiment is air, flowing through the passage 208, which results in a lower pressure being delivered to the print head 50. The size of the first opening 210 is determined using methods that are known in the art so that a desired purge pressure can be delivered to the print head 50 when the pump is running at a known rate. By providing the first opening 210, a commercially available pump that delivers a constant pressure that is higher than the desired purge pressure may be used to deliver the purge pressure. Furthermore, by bleeding off some of the fluid, the system minimizes noise, pressure spikes, etc., to deliver a more constant output pressure to the print head.

A second opening 214 is located downstream from the first opening 210. The second opening 214 allows fluid and/or pressure that was not bled off by the first opening 210 to bleed out of the second opening before traveling to the print head 50, thus the system may deliver a second pressure, or assist pressure, to the print head. The size of the second opening 214 is determined using methods that are known in the art so that a desired assist pressure can be delivered to the print head 50 when the pump is running at a known rate.

In the exemplary embodiment depicted in FIG. 4, the second opening 214 communicates with a valve 218 that selectively opens and closes the second opening 214. The valve 218 in the exemplary embodiment is a solenoid valve; however, other conventional valves may also be used. The valve 218 communicates with a purge controller 108 that controls the valve. The purge controller 108 may be incorporated into the system controller 100 or may be a stand alone controller, such as a programmable controller, or microprocessor, which is configured to control the valve and the air pump in a known manner. For example, the purge controller 108 may generate control signals that are delivered to the air pump and valve.

Figure 5:
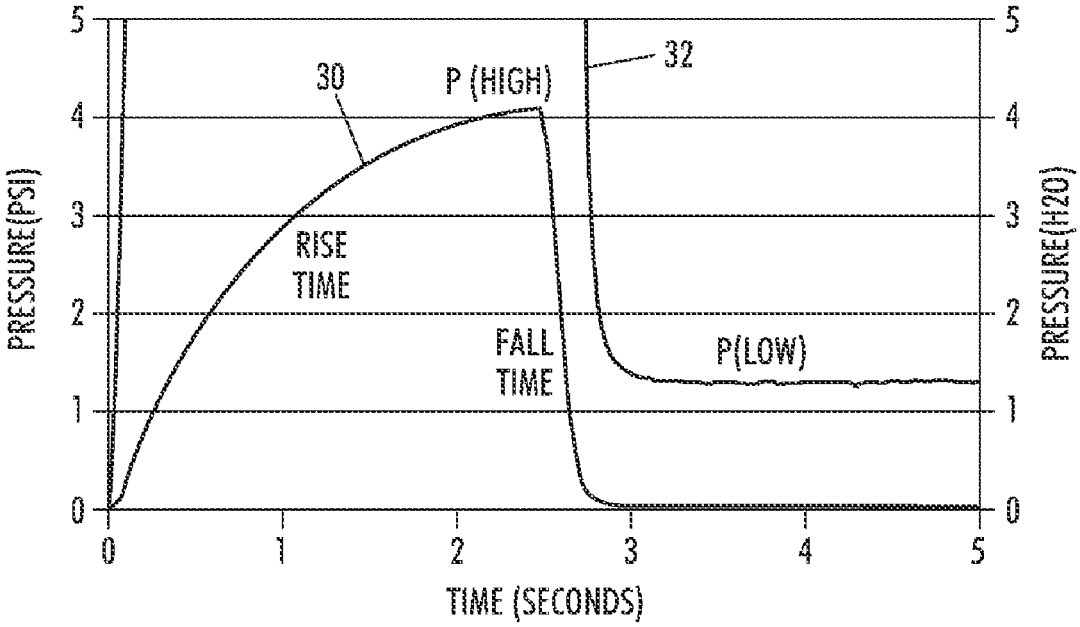
FIG. 5 is a graph of pressure versus time, in a dual pressure scale, for the pump system of FIG. 4.

With reference to FIG. 5, line 30 depicts the pressure rise during a purge cycle from time 0 to approximately 2.7 seconds. At time 0 the purge controller 108 delivers a signal to the valve 218 to close the opening 214. The pressure being delivered to the print head 50 during a purge cycle rises up to about 4.1 psi at 2.7 seconds. The purge controller 108, which may include a timer, opens the valve 218 at a predetermined time (2.7 seconds in this example), and air bleeds off through the passage 214 quickly lowering the pressure delivered to the print head to about 1.3 inches of water, as seen from line 32. Lines 30 and 32 represent the same purge cycle, but line 30 measures the pressure in psi and line 32 measures the pressure in inches of water. FIG. 5 is only one non-limiting example of a purge cycle for an ink jet printer. The shape of the lines 30 and 32 may change when using a different pump or a passage having different dimensions or different sized openings.

The purge controller 108 has been described as opening the valve 218 at a predetermined time. This was used in the exemplary embodiment because it was found to be the most inexpensive method for delivering two distinct pressures to the print head. In an alternative embodiment, the valve 218 may be configured to automatically open at a predetermined pressure and remain open until the next purge cycle.

The purge controller 108 may also control the amount of power supplied to the pump. In this alternative, the purge controller may allow for the delivery of a higher amount of power from the power source to the pump 204 during the purge cycle. Once the valve 218 is opened, the purge controller 108 may allow for the delivery of a lower amount of power to the pump. The lower amount of power, however, should be enough power to allow the pump to deliver a constant or near constant pressure as shown in the nearly horizontal right hand portion of line 32 in FIG. 5. The pump 204 continues to run after the purge cycle and the second opening 214 bleeds off fluid to lower the pressure delivered to the print head 50 to the assist pressure.

The purge system has been described with reference to a phase change ink jet printer; however, the purge system may also be used in other types of ink jet printers where one desires to deliver multiple different pressures to the print head assembly. Additionally, the exemplary system has been described to deliver only two different pressures; however, by adding additional orifice and valve pairs, several different pressures can be delivered to an apparatus with a very inexpensive pressure system. For a more detailed description of a purge system that is configured to deliver multiple pressures to a print head assembly, please refer to U.S. Pat. No. 7,111,917 entitled "Pressure Pump System" assigned to the same assignee as this application which is hereby incorporated by reference herein in its entirety.

As mentioned above, tests have shown that IWM jet failures may recover automatically after a sufficient amount of time has passed (about 30 sec to 2 minutes, for example) without the need of performing a purge. Therefore, IWM jet failures may recover without having to stop printing. Print quality, however, may continue to be impacted while awaiting the automatic recovery of IWM jet failures.

As an alternative to stopping printing operations to perform a purge procedure to recover IWM jet failures or simply waiting for the IWM jet failures to recover on there own, a method of recovering IWM jet failures has been developed that involves the application of a short high-pressure pulse to the print head assembly that is strong enough to move the meniscus of the ink in the ink jet orifices, but is weak enough such that ink is not ejected from the orifices or drawn back into the printhead. Testing has shown that the application of such a short high-pressure pulse may dramatically reduce the time required to eliminate IWM jet failures. The application of a short-high pressure pulse to the print head assembly may be implemented using the purge system described above.

Pressure pulses applied to the printhead may have any suitable magnitude and/or duration, and may be either positive or negative. Positive pressure pulses may be configured to bulge the ink at the nozzle while negative pressure pulses may be configured to move or "pull" the meniscus of the ink at the inkjets towards the interior of the printhead. In either case, the pressure pulse oscillates the ink at the nozzles which may have a beneficial affect on the performance of the nozzles The duration and magnitude of the pressure pulse applied to the print head assembly is very accurately controlled so that a repeatable and precise pressure pulse can be applied to the print head assembly. For example, to apply the pressure pulse to the print head assembly 50, the purge controller 108 delivers a signal to the valve 218 to close the opening 214. The pressure being delivered to the print head assembly 50 begins to increase toward the purge pressure. At a predetermined time, which may be approximately 0.05 seconds to approximately 1.5 seconds, the purge controller 108 opens the valve 218 and air bleeds off through the passage quickly lowering the pressure delivered to the print head to the assist pressure. The pressure pulse may have any suitable magnitude and/or duration that is capable of oscillating the meniscus of the ink in the ink jets without causing ink to be ejected or drawn back into the ink jets. In one embodiment, the pressure pulse is applied at a pressure of approximately 0.1 psi to approximately 8.0 psi.

Pressure pulses may be applied singularly or in combination to form a pulse train, for example, in which a plurality of pressure pulses may be applied one after the other for a predetermined duration. The pressure pulses in the pulse train may be substantially the same magnitude and/or duration of pulse. Alternatively, pressure pulses in a pulse train may have different magnitudes. For example, pressure pulses of different magnitudes may be applied to the printhead to further oscillate the ink at the nozzles of the printhead.

Referring now to FIG. 6, there is shown a chart that depicts the impact on IWM jet failures both with and without the application of the pressure pulse. The chart illustrates the results of tests that were conducted to generate data to show the impact of the high-pressure pulse on IWM jet failures. The number of IWM jet failures has been found to increase with increasing drop mass, and thus with increasing voltage level of the driving signals that cause the ejection of drops. Therefore, in order to perform the tests, IWM failures were generated by increasing the drive voltage from an operational voltage to a test voltage. In this embodiment, the operational voltage is approximately 33.5 V, and the test voltage is approximately 40.2 V although any suitable voltages may be used.

During the testing, a print head assembly, such as the one described above, was jetted for approximately 5 minutes at the test voltage to induce IWM jet failures. The drive voltage was then returned to the operational voltage. The chart of FIG. 6 shows the results of three tests that were conducted. The first test is a baseline test in which after the print head assembly was jetted at the test voltage for 5 minutes a pressure pulse was not applied. As can be seen in FIG. 6, in the baseline test after the 5 minutes of jetting at the test voltage 24 IWM jet failures were detected. After turning down the voltage to the operational voltage and waiting for 15 seconds, there were still 25 IWM jet failures. IWM jet failures were then detected every 15 seconds after that, i.e. at t=30 s, t=45 s, and t=90 s. In the baseline test, the number of IWM jet failures dropped to 14 at t=30 s, and eventually down to 9 IWM jet failures at t=90 s. Typically, all of the IWM jet failures recover after about 2 minutes. Similar to the baseline tests, in the $2^{nd}$ and $3^{rd}$ tests, the print head assembly was jetted for 5 minutes at the test voltage to induce IWM jet failures. 36 IWM jet failures and 18 IWM jet failures were induced in the $2^{nd}$ and $3^{rd}$ tests respectively. However, in contrast to the baseline test, once the voltage was returned to the operational voltage, a short duration high pressure pulse was applied to the print head assembly which bulged the meniscus in the ink jets without ejecting any ink. After the pressure pulse was applied to the print head assembly, the number of IWM jet failures at t=15 s dropped to 4 IWM jet failures and 2 IWM jet failures, respectively, for the $2^{nd}$ and $3^{rd}$ tests. Thus, the number of IWM jet failures was reduced approximately 90% compared to the baseline test.

Positive pressure pulses may be delivered to the print head assembly at any suitable time to recover and prevent ink jet failures. For example, because the pressure pulse is intended to only modulate the ink meniscus without ejecting drops of ink, the pressure pulse may be executed at any time the jets are not being used for printing in a manner that avoids or minimizes disruption of standard printing operations. For example, in one embodiment, the pressure pulse may be delivered to the print head during inter-job intervals between the printing of one print job and the next print job. Depending on the duration of the pressure pulse and the time needed for the bulged ink meniscus to recover to a standard position within the ink jet orifices, the pressure pulse may be delivered during inter-image intervals between the printing of images of a print job. The ink jet imaging device may include an interval detector as is known in the art for detecting the intervals between print jobs or between images of a print job. Any suitable technique and algorithm may be used to detecting or determining intervals during which a pressure pulse may be delivered to the print head assembly.

Those skilled in the art will recognize that numerous modifications can be made to the specific implementations of the melting chamber described above. Therefore, the following claims are not to be limited to the specific embodiments illustrated and described above. The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

What is claimed is:

1. A method of operating a phase change ink imaging device, the method comprising:

fluidly connecting a pressure source to a print head assembly of a phase change ink imaging device, the print head assembly including a plurality of ink jets for emitting ink drops onto an ink receiver; and activating the pressure source to deliver a pressure pulse to the print head assembly, the pressure pulse being delivered at substantially a purge pressure, the pressure pulse having a pulse duration such that the pressure pulse bulges ink from the plurality of ink jets without emitting ink from the plurality of ink jets.

2. The method of claim 1, the activation of the pressure source to deliver the pressure pulse to the print head assembly further comprising:

activating the pressure source to deliver the pressure pulse to the print head assembly, the pressure pulse being delivered at substantially a pressure between approximately 0.1 and approximately 8 pounds per square inch (psi), and the pulse duration being approximately 0.05 seconds to approximately 1.5 seconds.

3. The method of claim 2, the pressure pulse being delivered at approximately 4.1 psi, and the pulse duration being approximately 1 second.

4. The method of claim 2, the pressure pulse being a positive pressure pulse having a pressure between approximately 0.1 and approximately 8 psi.

5. The method of claim 2, the pressure pulse being a negative pressure pulse having a pressure between approximately −0.1 and approximately −8 psi.

6. The method of claim 1, the activation of the pressure source to deliver the pressure pulse to the print head assembly further comprising:

activating the pressure source to deliver a pressure pulse train to the print head assembly, the pressure pulse train including a plurality of pressure pulses, each pressure pulse in the plurality being delivered at a pressure between approximately 0.1 and approximately 8 psi.

7. The method of claim 6, the pressure of each pressure pulse in the pressure pulse train being approximately equal.

8. The method of claim 6, the pressure of the pressure pulses in the pressure pulse train being variable from pulse to pulse.

9. A system for reducing intermittent weak or missing (IWM) jet failures in an ink jet imaging device, the system comprising:

a pressure source fluidly connected to a print head assembly of an ink jet imaging device to deliver a purge pressure to the print head assembly; and a maintenance controller for activating the pressure source to deliver a pressure pulse to the print head assembly, the pressure pulse being delivered at substantially the purge pressure, the pressure pulse having a pulse duration such that the pressure pulse bulges ink from the plurality of ink jets without emitting ink from the plurality of ink jets.

10. The system of claim 9, the pressure pulse being delivered at a pressure between approximately 0.1 and approximately 8 pounds per square inch (psi), the pulse duration being between approximately 0.05 seconds and approximately 1.5 seconds.

11. The system of claim 10, the pressure pulse being delivered at approximately 4.1 psi, and the pulse duration being approximately 1 second.

12. The system of claim 9, the pressure pulse being a positive pressure pulse having a pressure between approximately 0.1 and approximately 8 psi.

13. The system of claim 9, the pressure pulse being a negative pressure pulse having a pressure between approximately −0.1 and approximately −8 psi.

14. The system of claim 9, the maintenance controller being configured to activate the pressure source to deliver a pressure pulse train to the print head assembly, the pressure pulse train including a plurality of pressure pulses, each pressure pulse in the plurality being delivered at a pressure between approximately 0.1 and approximately 8 psi.

15. The system of claim 14, the pressure of the pressure pulses in the pressure pulse train being variable from pulse to pulse.

16. A phase change ink imaging device comprising:

a print head assembly for ejecting ink onto an ink receiver;

an air pump configured to deliver a pressure;

a passage for fluidly connecting the air pump to the print head assembly; and a maintenance controller for activating the air pump to deliver a pressure pulse to the print head assembly via the passage, the pressure pulse being delivered at a pressure between approximately 0.1 and approximately 8 psi, the pressure pulse having a pulse duration being between approximately 0.05 seconds and approximately 1.5 seconds.

17. The imaging device of claim 16, the pressure source being connected to the print head assembly via a passage, the passage having an opening for bleeding off pressure from the pressure source, the opening having a valve configured to be moved between an open position and a closed position, the purge pressure being delivered to the print head assembly when the valve is in the closed position and an assist pressure being delivered to the print head assembly when the valve is in the open position, the purge pressure being greater than the assist pressure.

18. The imaging device of claim 17, the maintenance controller being operably connected to the valve, and the maintenance controller being configured to move the valve to the closed position for the pulse duration and to move the valve back to the open position after the pulse duration.

19. The imaging device of claim 18, the print head assembly being configured to eject liquid phase change ink onto the ink receiver.

20. The imaging device of claim 19, the ink receiver comprising an intermediate imaging member.

* * * * *